US006247700B1

(12) United States Patent
Procupetz

(10) Patent No.: US 6,247,700 B1
(45) Date of Patent: Jun. 19, 2001

(54) LIGHT EMITTING SHOOTING TARGET

(75) Inventor: Gabriel Procupetz, Barcelona (ES)

(73) Assignee: Oriel Tecnologicas, S.A., Barcelona (ES)

( * ) Notice: Subject to any disclaimer, the term of this patent is extended or adjusted under 35 U.S.C. 154(b) by 0 days.

(21) Appl. No.: 09/450,983

(22) Filed: Nov. 29, 1999

(30) Foreign Application Priority Data

Jul. 29, 1999 (ES) ..... 9902017 U

(51) Int. Cl.[7] ..... F41J 1/00
(52) U.S. Cl. ..... 273/408; 273/348
(58) Field of Search ..... 273/378, 371, 273/373, 377, 403, 404, 406–409, 348, 348.1; 463/52

(56) References Cited

U.S. PATENT DOCUMENTS 4,205,846 * 6/1980 Levine ..... 463/52
4,260,160 * 4/1981 Ejnell et al. ..... 273/408
4,346,901 * 8/1982 Ejnell et al. ..... 273/408
5,580,063 * 12/1996 Edwards ..... 273/378

* cited by examiner

*Primary Examiner*—Mark S. Graham
(74) *Attorney, Agent, or Firm*—Harrison & Egbert

(57) ABSTRACT

A target having a support sheet (1) wherein are superimposed a layer (2) of conductive paint connected to a conductive wire (3), a layer (4) of dielectric material, a layer (5) of conductive paint connected to a conductive wire (6), a layer (7) of phosphor-based electroluminescent material and a layer (8) of transparent conductive material, being the conductive wires (3 and 6) attached to a connector (9) for connection of the shooting target to an alternating or direct-current transformer (10), a photovoltaic cell or a supply battery. This target which is of the type of those used with firearms, has the peculiarity of becoming illuminated, thus enhancing its night vision.

3 Claims, 1 Drawing Sheet

LIGHT EMITTING SHOOTING TARGET

DESCRIPTION

1. Object of the Invention

This invention is a shooting target that includes a support sheet and a number of layers made of different materials. One of the materials is an electroluminescent material that lights up when an electric current is supplied to the target, thus making it visible at great distances and easier for shooters to see.

2. Field of the Invention

This target can be used in shooting venues and ranges where shooting is practiced at night or with very little natural light.

BACKGROUND OF THE INVENTION

Shooting targets are generally made up of sheets of paper or cardboard printed with a series of concentric circles and two orthogonal lines that divide it into four quadrants, which facilitates measuring the horizontal or vertical deviation of the bullet strikes.

The problem with these targets is that when shooting is practiced in dark places or places with little natural light, they are difficult to see, thus making it necessary to light the shooting range. This is not always possible and involves consuming a great deal of electricity or postponing the shooting activities until the next day.

DESCRIPTION OF THE INVENTION

The present invention is a light emitting target which is made in such a way that it lights up when an electric current is supplied to it, thus making the use of incandescent, halogen or fluorescent lights or any other kind of light unnecessary.

In accordance with the invention, this target is made up of: a rear support sheet, a layer of carbon- or silver-based conductive paint, a layer of dielectric material, a second layer of carbon- or silver-based conductive paint, a layer of phosphorous-based electroluminescent material and, finally, a layer of transparent conductive material.

The layers of conductive paint are connected to conductive wires, through which a low-amp electric current is supplied to the target so that the electroluminescent layer lights up.

Electricity can be supplied to the shooting target by means of an alternating- or direct-current transformer connected to an electrical power outlet or by means of photovoltaic cells anywhere that electricity is not available. Button-type batteries can also be used.

The conductive wires connected to the layers of conductive paint should preferably be attached to a connector included in the target itself so that it can be connected to any of the supply sources mentioned in the foregoing paragraph. Thus, the connector will make it. fast and easy to connect or disconnect the target when it needs to be changed.

This light emitting target has a number of important advantages over standard targets. The most important of these is the fact that it can be seen in the dark at great distances, thus suitably marking the references for shooting practice. It is also very easy to replace once it has been perforated by bullets. More specifically, it is merely necessary to extract the connector through which current is supplied to the target in order to replace a target.

DESCRIPTION OF FIGURES

To complement the description provided thus far and to facilitate comprehension of the features of the invention, this descriptive report contains a pair of drawings that include, but are not limited to the following.

PREFERRED EMBODIMENT OF THE INVENTION

Figure 1:
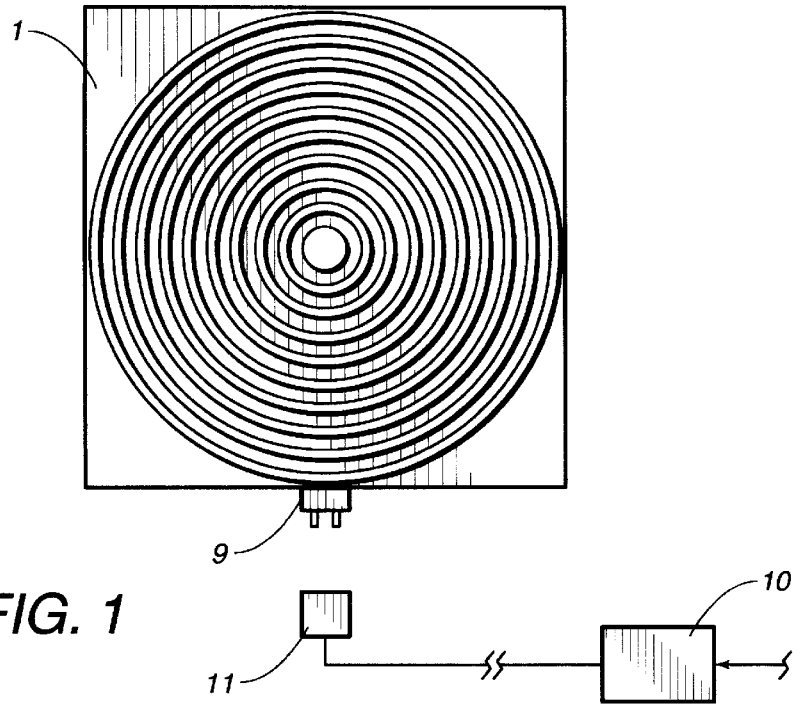
FIG. 1 shows an elevation view of the shooting target, equipped with the corresponding electric connector. The electricity-supply means via an alternating- or direct-current transformer are shown with the corresponding out-port.
Figure 2:
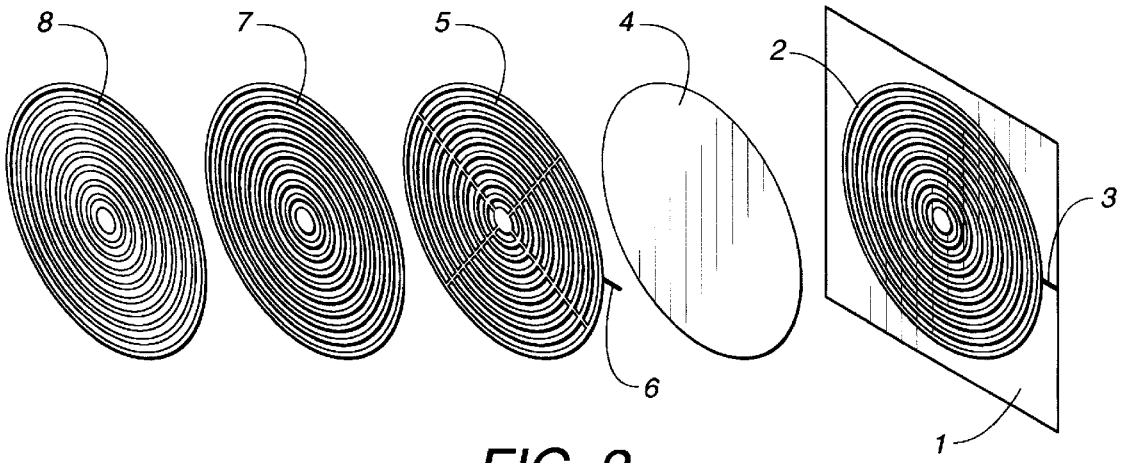
FIG. 2 shows a perspective view of the shooting target in which the different layers that make up the target are represented at a slight distance from one another to make them easier to see.

As is shown in the two figures, the light emitting shooting target, is made up of a support sheet (1), a layer (2) of conductive paint connected to a conductive wire (3), a layer (4) of dielectric material, a layer (5) of conductive paint connected to a conductive wire (6), a layer (7) of phosphorous-based electroluminescent material and a layer (8) of transparent conductive material.

The support sheet (1) is made of paper, cardboard, plastic or PVC and layers (2 and 5) are painted with carbon- or silver-based conductive paint.

The conductive wires (6), through which the low-amp electric current is supplied to the shooting target so that the layer (7) of phosphorous-based electroluminescent material lights up, can be associated with a connector (9), as shown in FIG. 1, so that the target can be connected and disconnected quickly and easily when it must be replaced.

In the example shown in FIG. 1, the power supply source to the shooting target is represented by an alternating-current transformer (10), equipped with an out-port with a connector (11) corresponding to the connector (9) on the shooting target.

After having sufficiently described the nature of the invention and provided an example of preferable construction, it should be stated that the materials, shape, size and arrangement of the elements described can be modified, provided that they do not represent an alteration of the essential features of the invention as stipulated in the following claims.

What is claimed is:

1. A light emitting shooting target for use in shooting ranges, comprising a support sheet (1), a layer (2) of conductive paint connected to a conductive wire (3), a layer (4) of dielectric material, a layer (5) of conductive paint connected to a conductive wire (6), a layer (7) of phosphorous-based electroluminescent material and a layer (8) of transparent conductive material.

2. The shooting target according to claim 1 wherein the different layers (2, 4, 5 and 7) are superimposed on the support sheet (1) and are connected to one another.

3. The shooting target according to claim 1 Wherein all the conductive wires (3 and 6) are attached to a connector (9) for optional connection of the shooting target to an alternating or direct-current transformer (10), a photovoltaic cell or a supply battery.

* * * * *